US006368257B1

(12) United States Patent
Kaplan et al.

(10) Patent No.: US 6,368,257 B1
(45) Date of Patent: Apr. 9, 2002

(54) EXERCISE ASSEMBLY

(76) Inventors: Earl M. Kaplan, 5582 NW. 79th Ave., Miami, FL (US) 33166-4195; Alan H. Mandell, 20334 NW. 2nd Ave., Miami, FL (US) 33169

( * ) Notice: Subject to any disclaimer, the term of this patent is extended or adjusted under 35 U.S.C. 154(b) by 0 days.

(21) Appl. No.: 09/528,859

(22) Filed: Mar. 20, 2000

(51) Int. Cl.[7] ..... A63B 69/10
(52) U.S. Cl. ..... 482/124; 482/112
(58) Field of Search ..... D21/662; 482/124, 482/121, 126, 105, 133, 112, 122, 127, 128

(56) References Cited

U.S. PATENT DOCUMENTS

| | | | | |
|---|---|---|---|---|
| 4,080,962 A | | 3/1978 | Berkeley | |
| 4,325,363 A | | 4/1982 | Berkeley | |
| 5,199,940 A | | 4/1993 | Morris et al. | |
| 5,211,163 A | | 5/1993 | Mortenson | |
| 5,462,518 A | * | 10/1995 | Hatley et al. | 602/36 |
| 5,476,435 A | * | 12/1995 | Nimmo | 482/124 |
| 5,588,941 A | | 12/1996 | Scott | |
| 5,674,164 A | * | 10/1997 | Kravitz | 482/126 |
| 5,769,764 A | * | 6/1998 | Tilberis | 482/124 |
| 5,816,251 A | | 10/1998 | Glisan | |
| 5,820,533 A | | 10/1998 | Goldman | |
| 5,964,685 A | * | 10/1999 | Boland | 482/122 |

FOREIGN PATENT DOCUMENTS

| | | | |
|---|---|---|---|
| FR | 2591496 | * 12/1985 | 482/127 |

* cited by examiner

*Primary Examiner*—Jerome Donnelly
(74) *Attorney, Agent, or Firm*—Malloy & Malloy, P.

(57) ABSTRACT

An isotonic exercise assembly structured to exercise the retractor muscles, such as but not necessarily limited to the rhomboid muscles, in the upper torso of a user's body in an effort to correct poor posture demonstrated by the user. A mounting assembly is provided and structured to be removably attached to the upper torso, and is supportingly attached to a base of the exercise assembly. A pair of arms, are pivotally attached at their respective distal ends to the base in spaced relation to one another and are selectively positionable between a retracted position and an outwardly extended position. A tension assembly is disposed relative to the base and the pair of arms, and exerts a resistance force on the arms tending to normally bias the arms into the retracted position. The user exerts a pulling force on the arms in opposition to the resistance force by the tension assembly and the arms are thereby disposed into the outwardly extended position concurrently to the user preforming a scapular movement. The tension assembly can be adjusted to regulate the resistance force applied to the arms before, during and after the performance of a predetermined number of repetitions, wherein each repetition comprises the movement of the arms from the retracted position to the extended position and back into the retracted position.

26 Claims, 5 Drawing Sheets

EXERCISE ASSEMBLY

BACKGROUND OF THE INVENTION

1. Field of the Invention

This invention relates to an isotonic exercise device structured to repeatedly exercise the retractor muscles and particularly the rhomboid muscles in the upper torso of a user's body. The exercise assembly is substantially compact and portable, and when properly utilized, helps those individuals having a history of neck, shoulder or back disorders, as well as enhances the overall health and condition of the spinal column. The exercise assembly of the present invention therefore greatly facilitates a user, when following a predetermined exercise regiment, in achieving a better posture especially within the upper torso and neck region, as well as diminishing degenerative changes that normally occur in individuals with poor posture.

2. Description of the Related Art

In recent years there is been an ever increasing tendency for the general population to follow a healthier life style in an effort to improve a person's general well being and also to improve ones appearance. Such an improved life style frequently incorporates a somewhat restricted, low fat diet in addition to an increased amount of physical activity in the form of exercise. Typically, an exercise regiment followed by most individuals seriously concerned with the improvement of their body includes cardiovascular type exercises as well as exercises directed to the development of specific muscles groups or areas of the body where fat deposits have collected. In order to perform the required exercises in a more efficient and convenient manner, different types of exercise devices and/or apparatus have been developed. Such equipment is typically designed to facilitate the performance of specific exercises which concentrates on predetermined areas of the body, dependent on which portion of the body or specific muscle group a person wishes to develop.

Numerous exercise assemblies of somewhat conventional design are known and commercially available and typically include springs, flexible material bands, weights and elastic resistance elements. These resistance structures are normally connected to a plurality of attachment members and/or platforms on which the user reclines or is otherwise supported or which the user engages in a predetermined, intended manner. Such known exercise assemblies are designed and structured to allow the performance of one or more exercises in a manner which hopefully provides the most benefit to the muscle grouping or body area intended to be exercised. In addition, as part of certain known or conventional exercise assemblies, the utilization of substantially large and somewhat fixed apparatus is sometimes utilized. Generally, this larger or more permanent type of apparatus usually includes some type of support platform having sufficient structural integrity to support at least a portion, if not all of the user's weight, so as to orient the user in a position which facilitates manipulation of the resistance assembly, including resistance elements, springs, weights, etc., as set forth above.

While the conventional or known exercise equipment of the types set forth above have enjoyed a certain amount of commercial success and accordingly are generally considered to be functional for their intended purpose, there are certain recognized disadvantages associated with the use of such apparatus. Such disadvantages include, but are not necessarily limited to, the size, weight, and generally bulky nature of such equipment. Accordingly, it is well recognized that numerous types of exercise equipment are clearly incapable of being easily relocated or moved and most certainly are not considered to be portable, at least to the extent of traveling with the user between locations. By way of example, one often finds that in a motel, hotel, or like temporary residence facility, there is no spa, gymnasium or exercise equipment available to the patrons. Because of such situations the exercise equipment industry, at least to a limited extent, has recognized that a certain segment of the consuming public would prefer to utilize portable exercise equipment at certain times or in certain locations, when conventionally sized apparatus is not available. As a result, a number of relatively small, light weight "body toners", as well as other collapsible or detachable exercise assemblies are now available to the public.

Accordingly, while the exercise equipment industry has made an effort, at least to a minimal extent, directed to the overcoming of certain disadvantages and problems well recognized in the industry, the vast majority of the exercise equipment commercially available is designed for the building or developing of certain muscle groups in order to better shape the physique or alternatively to reduce certain areas of the body such as the waist, thighs, buttocks, etc. As a result, none of the generally well known and conventionally designed and structured exercise apparatus is intended to facilitate the user in the performance of isotonic exercises, which help correct well known anatomical problems such as poor posture of the lower and upper back or disorders associated with the shoulders, neck or spinal column. Indeed, it is well established that the ability to improve posture or sustain a correct posture is fairly easily accomplished by following an exercise regiment incorporating isotonic exercises which are specifically designed to exercise the retractor muscles of the upper torso. However, even in light of this fact, there is still an absence in the exercise equipment industry of a device or apparatus designed and structured to facilitate a person easily and efficiently performing such exercises on a regular basis.

Therefore, there is a well recognized need for an isotonic exercise assembly which is sufficiently light weight and compact to be portable and therefore be easily carried by a user between different locations. In addition, such a preferred exercise assembly should also be specifically designed and structured to facilitate a user's performance of isotonic type exercises that will help the posture of most individuals, particularly those who suffer from pronated shoulders, which are physically indicated by the shoulders of a person being rounded and extending somewhat forwardly. Such a preferred exercise assembly should also aid those individuals who have a history of neck, shoulder, or back disorders, by generally enhancing the condition of the spine. An important objective of such an improved and preferred exercise assembly would be to allow people to achieve a better posture, particularly of the upper torso and neck region, as well as significantly reduce or delay the occurrence of degenerative changes that invariably occur in a person demonstrating poor posture. In addition, this type of improved exercise assembly should be structured to have sufficient versatility to allow the user to perform the intended exercises, while being oriented in either a standing position or a sitting, substantially upright position.

SUMMARY OF THE INVENTION

The present invention is directed to an exercise assembly capable of being removably mounted on the body of a user and particularly in a supported position on the upper torso, in substantially overlying, accessible relation to the chest area. A mounting assembly is provided and includes a plurality of adjustably connected straps, defining a supporting harness. The mounting assembly is dimensioned and configured to substantially surround and be at least partially supported about the shoulders of the user, and includes a support plate secured to the harness and disposed in overlying, engaging relation to the upper chest area. The aforementioned adjustable features of the harness allows the positioning of the front support plate into a predetermined, preferred location dependent on the stature or overall configuration of the user.

The harness, and in particular the front support plate, is used to supportingly secure a base on the user's body in a preferred, operative position. The base, includes a pair of arms movably connected thereto, wherein the base and the arms define what may be generally referred to as the operative or active portion of the exercise assembly of the present invention. More specifically, the base and movably connected pair of arms are positioned such that the arms may be repeatedly disposed between a retracted or neutral position, normally assumed by the arms when not engaged by the user, and an extended position. Selected positioning of the arms between the retracted and extended positions is accomplished by the hands of the user gripping the outer or distal ends of each arm and exerting an outwardly directed pulling force thereon which is sufficient to move the arms between the aforementioned inwardly disposed retracted position and outwardly disposed, extended position. In addition, a complete repetition of the exercise prescribed when using the exercise assembly of the present invention may also include the user maintaining the pulling force on the arms, while the arms are allowed to slowly return from the outwardly extended position to the retracted position. As will be explained in greater detail hereinafter, a complete set of exercises comprises a predetermined number of repetitions, wherein the user repeatedly forces the arms from the retracted position to the extended position and subsequently allows the arms to return from the outwardly extended position back to the retracted or neutral position. For best results, the above described exercise motion should be performed slowly, in order to exert the optimum stress on the intended retractor muscles of the upper torso and particularly the rhomboid muscles. Also, when performing the exercises in the intended manner, as described above, the upper torso of the user should be maintained in an erect position, while either standing or sitting, with the vertex of the head disposed in a superior position.

In order to provide an adequate resistance force to the user and thereby place a required or predetermined amount of stress on the intended muscle group to be exercised, the exercise assembly of the present invention also includes a tension assembly. The tension assembly may take a variety of structural embodiments, at lest some of which include a biasing assembly mounted on or connected to the base and disposed in biasing interconnection with each of the arms in a manner which normally biases the pair of arms into the aforementioned retracted position and/or provides resistance to the outwardly directed pulling force exerted on the arms by the user, when forcing the arms from the retracted position to the extended position. Furthermore, based upon the structure of the present invention, as the user grips the handles, defined at the outer or distal ends of each arm, and exerts a pulling force thereon, the arms are selectively moved in a substantially semi-circular motion. As such, when repeatedly moving the arms in the intended manner, the user must exert a sufficient force thereon to overcome a resistance force created by the tension assembly in normally biasing the pair of arms into the retracted position. Another feature of at least one embodiment of the present invention is the structuring of the tension assembly such that it can be adjusted to vary the resistance force exerted on the arms, thereby causing the user to exert either a greater or lesser force as he or she repeatedly causes movement of the arms between the retracted position and the outwardly extended position.

Yet another feature of at least one embodiment of the present invention is the ability to laterally or horizontal adjust the spacing between the arms, and more particularly between the proximal ends thereof, in order to accommodate a variety of different sizes, shape, etc. of the user. Accordingly, each of the arms may extend outwardly a variable distance from the base by means of being connected to one of two manually adjustable slide plates or like mounting structures disposed on an interior portion of the base and extendable outwardly therefrom in opposite directions. Each of the slide plates or like mounting structures is connected to a separate one of the arms, such that the arms can be independently adjusted by being extended outwardly from the base an equal distance or different distances.

As set forth above, the exercise assembly of the present invention is primarily structured to facilitate the user in performing isotonic exercises for purposes of developing the retractor muscles of the upper torso. More specifically, the isotonic exercise assembly of the present invention is intended to primarily exercise the rhomboid muscles, as well as other retractor muscle groups of the upper torso. In addition, the exercise of these predetermined muscle groups is best accomplished by the user concurrently performing a "scapular" movement, comprising the retracting of shoulder blades, at the same time that the pulling force is being exerted on both handles of the pair of arms, and as the arms move through the aforementioned semi-circular motion from the retracted position to the extended position. The scapular movement is more specifically defined by the user pulling the shoulder blades together to the closest point the body will allow, without causing undo discomfort or pain. This will allow the aforementioned retractor muscles to contract. This exercise, when repeatedly performed, will help the posture of most individuals and particularly those individuals who have pronated shoulders, wherein the shoulders are physically characterized by being rounded and normally assuming a forward orientation. In addition, the exercise assembly of the present invention, when properly utilized, will help those individuals having a history of neck, shoulder or back disorders, as well as enhance the overall health and condition of the spinal column. The exercise assembly of the present invention therefore greatly facilitates a user, when following a predetermined exercise regiment, in achieving a better posture especially within the upper torso and neck region, as well as diminishing degenerative changes that normally occur in individuals with poor posture.

These and other features of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

As shown in the accompanying drawings, the present invention is directed to an exercise assembly, generally indicated as 10, and shown mounted in a preferred, predetermined position on the upper torso or chest area of a user, generally indicated as 100. As will be explained in greater detail hereinafter, the exercise assembly 10 is structured to facilitate the user 100 in the performance of a prescribed set of isotonic exercises designed to help sustain good posture and correct bad posture, through the development of the retractor muscles, particularly but not exclusively, the rhomboid muscles of the upper torso of the user's body. Therefore, in order to perform the proper exercises as generally outlined above, the exercise assembly 10 is removably mounted on the user's body 100, and maintained in overlying and at least partially supported relation on the upper chest area, as shown in FIGS. 1 through 3.

Figure 4:
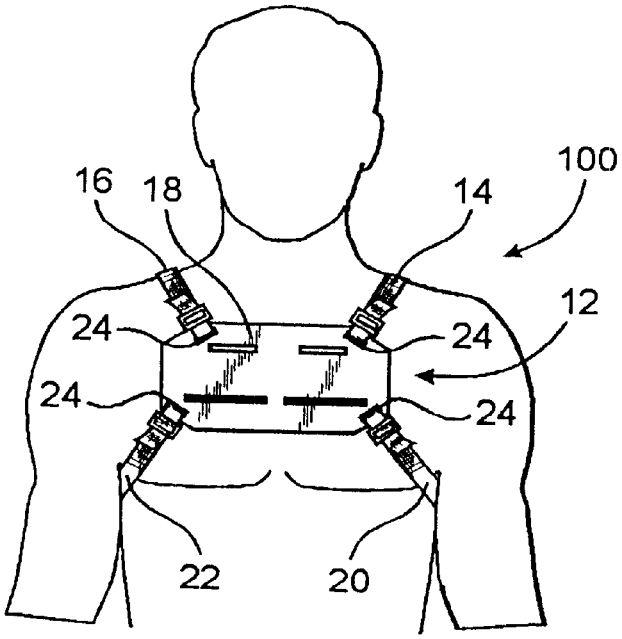
FIG. 4 is a front view in partial cut away of a mounting assembly associated with the exercise assembly of the present invention and mounted on a schematically represented user.
Figure 5:
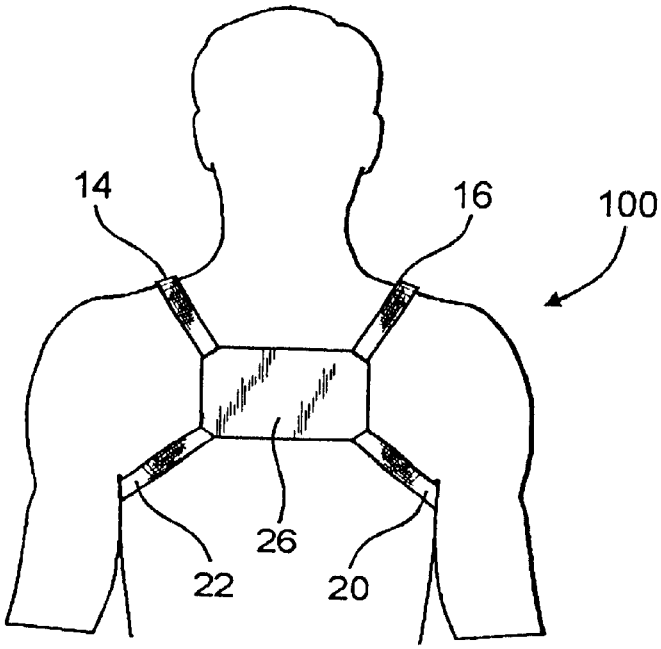
FIG. 5 is a rear view of the embodiment of FIG. 4.

In order to accomplish the proper positioning, the exercise assembly 10 comprises a mounting assembly, generally indicated as 12, and best shown in FIGS. 4 and 5. The mounting assembly 12 includes a harness defined by a plurality of straps 14 and 16 extending over and around the shoulder area of the user 100, and preferably adjustably attached to a front support plate 18. In addition, the harness of the mounting assembly 12 further includes a second plurality of straps 20 and 22, also adjustably connected in retaining relation to the front support plate 18. Adjustment of the straps 14, 16, 20, and 22 of the harness is preferably accomplished by a buckle structure, or any other type of applicable connector 24, which is attached to each of the straps 14, 16, 20 and 22 and which is structured to vary the length of the straps and thereby facilitate the correct, predetermined positioning of the front support plate 18 relative to the upper chest area of the user 100. With reference to FIG. 5, the harness also includes a supporting back plate 26 attached to each of the harness straps 14, 16, 20 and 22 and preferably disposed between the shoulder blades of the user 100. In addition, the back support plate 26 is dimensioned and configured so as to provide proper bracing or support of the remainder of the exercise assembly, as will be explained in greater detail hereinafter. The back support plate 26 is also disposed and structured to allow scapular movement by not interfering with the forced rotation of the user's shoulder blades towards one another during the performance of the intended exercise.

Figure 1:
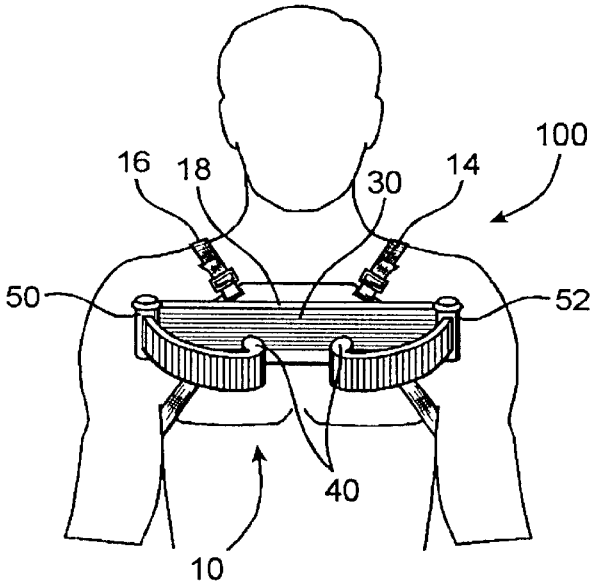
FIG. 1 is perspective view in partial cut away of the exercise assembly of the present invention mounted on a schematically represented user.
Figure 2:
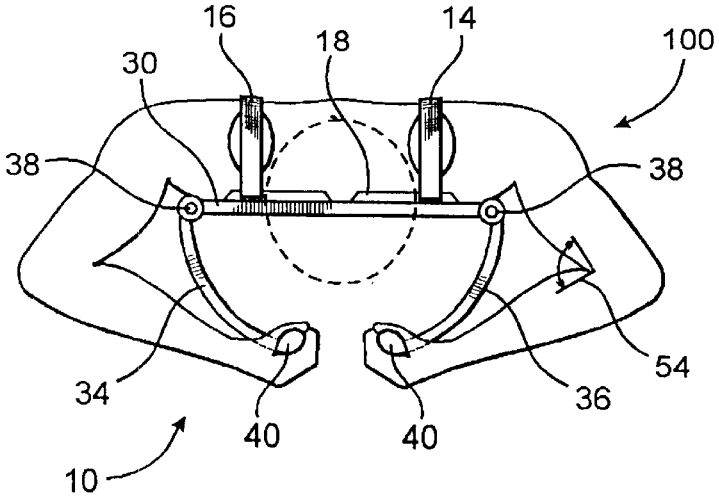
FIG. 2 is a top view of the embodiment of FIG. 1.
Figure 3:
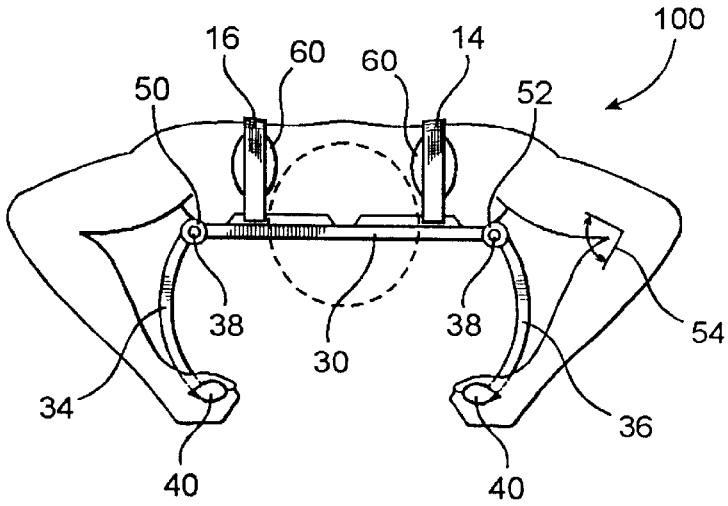
FIG. 3 is a top view of the embodiment of FIG. 1 with the exercise assembly of the present invention disposed in an operative position differing from that of FIG. 2.

An active or operative portion of the exercise assembly 10 comprises a base 30 having somewhat of an elongated configuration and disposed in a substantially transverse orientation to the length of the user 100, substantially across and in overlying relation to the upper chest area, as shown in FIGS. 1 through 3. Proper positioning of the base 30 is accomplished by its supporting attachment to the front support plate 18. The exercise assembly 10 of the present invention contemplates at least two embodiments, wherein the base 30 is fixedly secured to the outer surface of the front support plate 18 or alternatively is removably attached in supporting relation on the front support plate 18. In the former embodiment the base 30 is removably secured in its intended position on the body of the user 100 concurrently to the attachment of the harness, including each of the harness straps 14, 16, 20 and 22 being secured and properly adjusted. In the latter embodiment, the harness is secured to the user's body in the intended position shown in FIGS. 4 and 5 and the base 30 is subsequently, removably attached to the front support plate 18, utilizing any applicable connection assembly such as, but not limited to, a snap lock spine mounted on the support plate 18, and removably connected in supporting engagement to the base 30.

Another structural feature of the exercise assembly 10 of the present invention includes a pair of arms 34 and 36 each having a proximal end 38 movably, or more specifically, pivotally attached to the base 30 in spaced relation to one another. In addition, each of the arms 34 and 36 preferably includes a distal end defined by a handle 40. The pair of arms 34 and 36 are preferably connected to substantially opposite ends of the base 30 and are disposed in a neutral or normally retracted position as shown in FIG. 1. In the performance of the intended exercise, when utilizing the exercise assembly 10 of the present invention, the arms 34 and 36 are intended to be positioned between the normally retracted position as demonstrated in FIG. 1 and an outwardly extended position as demonstrated in FIG. 3. As shown, the retracted position is defined by the arms 34 and 36 disposed in spaced apart, substantially overlying relation to the base 30. Also, when in the retracted position, the distal ends or handles 40 are disposed a sufficiently spaced apart distance from one another to allow the hand of the user to grip the correspondingly disposed handle 40 of each arm 34 and 36 as shown in FIGS. 2 and 3. The outwardly extended position of the arms 34 and 36 is substantially defined by each of the arms 34 and 36 extending angularly outward from the base 30, at an angular orientation of at least 90 degrees. It is emphasized that the pair of arms 34 and 36 can of course assume different angular positions, other than 90 degrees relative to the base 30, when they are disposed in the extended position, dependent on the physical limitations of the user 100, and still correctly perform the intended exercise.

Figure 6:
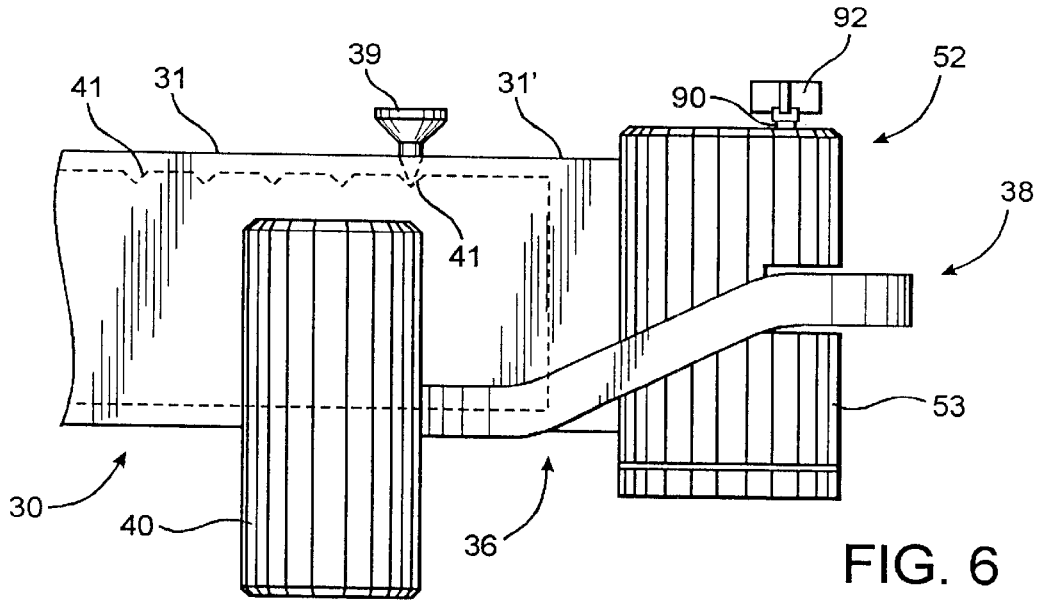
FIG. 6 is a front view in partial cutaway showing the base and one arm attached to the other, unseen portion of the base, an oppositely disposed arm being substantially a mirror image thereof.

The exercise assembly 10 of the present invention further comprises a tension assembly which is at least partially mounted on the base 30 and, in at least one embodiment, comprises two biasing structures 50 and 52, each at least partially connected to a different, correspondingly positioned one of the pair of arms 34 and 36. Also with reference to FIG. 6, the biasing structures 50 and 52 of the tension assembly may each include a housing 53 disposed at the end of a casing 31, which defines a portion of the base 30. In the illustrated embodiment, each of the housings 53 has an at least partially hollow interior so as to contain the various operative components of the biasing structures 50 and 52. It is emphasized that the biasing structures 50 and 52 may have a variety of different configurations, as explained in further detail with reference to FIGS. 9 through 12. However, each of the embodiments of the biasing structures 50 and 52 cooperatively function with the distal end 38 of each of the arms 34 and 36, at least to the extent that the distal ends 38 are formed into a somewhat cam-like configuration as at 38'. In each of the embodiments of FIG. 9 through 12 the cam configuration 38 ' is disposed such that each of the arms 34 and 36 are normally biased into the aforementioned neutral or retracted position. A user encounters a resistive force from each of the arms 34 and 36 as they are pulled in an outwardly directed path and as the user grips the handles 40 at the proximal end of each of the arms 34 and 36. This is generally due to the cam portion 38' compressing or pushing against the operative components of the various embodiments of the biasing structures 50 and 52.

Figure 8:
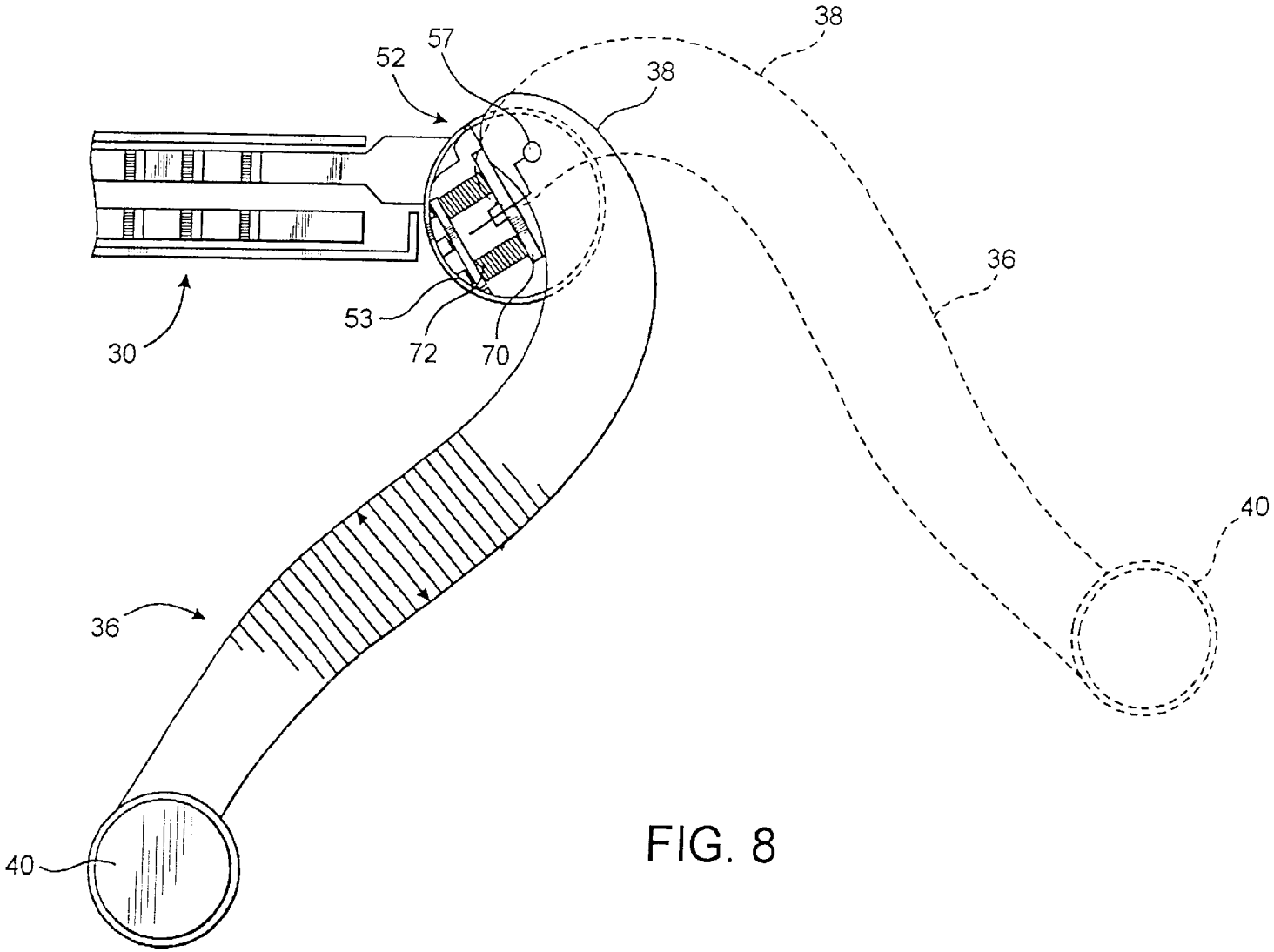
FIG. 8 is a detail view in partial cutaway and section of the embodiments of FIGS. 6 and 7, wherein the arm is shown in a retracted position in solid lines, and in an extended position in phantom lines.
Figure 9:
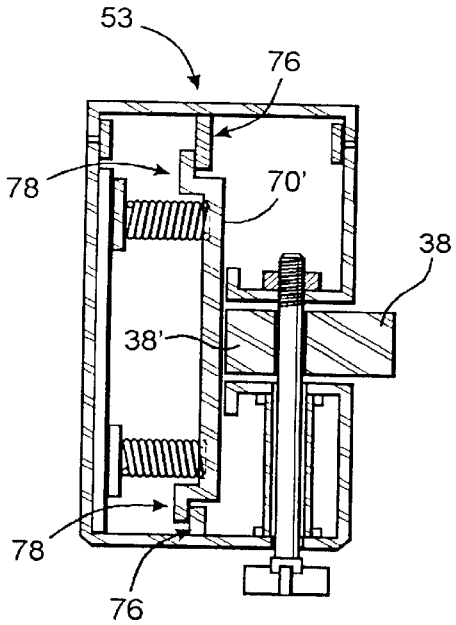
FIG. 9 is a sectional, interior view in detail of one embodiment of a tension assembly of the present invention.
Figure 10:
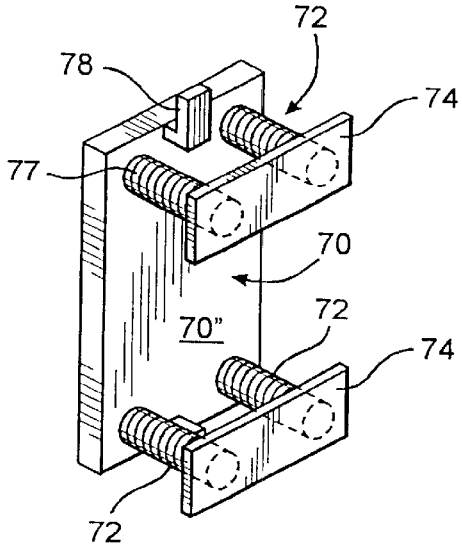
FIG. 10 is a perspective view of a component of the embodiment of FIG. 9.

One embodiment of the biasing structures 50 and 52 is shown in FIGS. 8 through 10. More specifically, housing 53 has a bearing plate 70 mounted therein, such that an outer surface thereof as at 70' is disposed in engaging relation with the curvilinear engaging cam surface 38' of the proximal end 38 of the arm 36. In addition, a plurality of biasing springs 72 are mounted on the opposite surface 70" of the bearing plate 70 and extend outwardly therefrom, such that members 74 are disposed to force the bearing plate 70' against the interiorly disposed stop portions 76. Outwardly projecting fingers 78 limit the outer disposition of the bearing plate 70 so that it operatively engages the cam surface 38'. As should be apparent, rotation of the arm between the neutral or retracted position and the outwardly extended position of each of the arms causes forced engagement between the cam surface 38' and the surface 70' of the bearing plate 70. Therefore the biasing springs 72 exerts the aforementioned resistance force against the arms, which must be overcome by the pulling force exerted on the arms 34 and 36 by the user, as set forth above. The relative positions of the cam surface 38' and the bearing plate 70 are represented, at least partially, in phantom lines in FIG. 8, as the arm 36 moves from the retracted position, represented in solid lines to the outwardly disposed extended position, represented in phantom lines.

Figure 11:
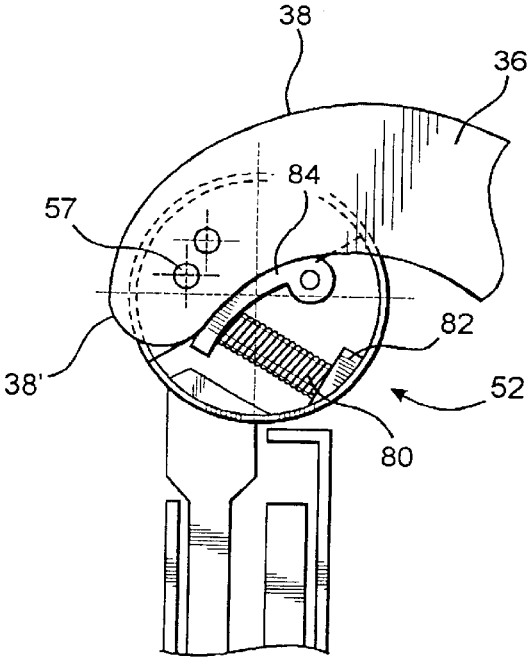
FIG. 11 is a top view in partial cutaway and phantom of another embodiment of the tension assembly different from that of FIGS. 9 and 10.

Yet another embodiment of each of the biasing structures 50 and 52 is shown in FIG. 11. In the embodiment of FIG. 11 one or more biasing springs 80 extend between member 82 and a curved bearing plate 84, which is disposed in biasing engagement with the cam surface 38' of the proximal end 38 of each of the arms 34 and 36. Similar to the operation of the embodiment of FIGS. 7 through 10, rotational or pivotal movement about supporting pivot pin or axis 57 causes the cam surface 38 ' to be forced against the outer or correspondingly disposed surface of the curved bearing plate 84. The aforementioned resistance force is generated by each of the arms 34 and 36 as they are forced outwardly from the neutral or retracted position to the outwardly disposed extended position, as set forth above.

Figure 12:
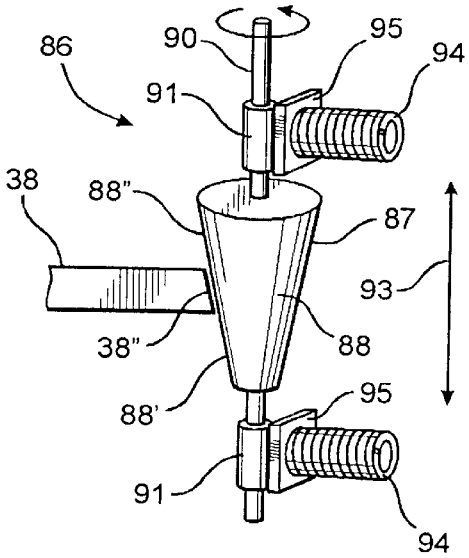
FIG. 12 is a perspective view in partial cutaway of yet another embodiment of the tension assembly which is structured to be adjustable and thereby vary the resistance force to which each of the arms are subjected by an associated tension assembly.

Yet another embodiment of the biasing structures 50 and 52 comprises an adjustable assembly generally indicated as 86 in FIG. 12. The adjustable biasing structure 86 includes a bearing member 87 having a cone-like configuration defined by a cylindrical, tapered bearing surface 88. The cone is mounted on a centrally disposed support shaft 90, which is maintained in a preferred orientation by at least one, but preferably a plurality of spaced apart slip collars or bushings 91. Rotation of the shaft 90 is accomplished by an adjustable knob or like structure 92 mounted on an exterior of the housing 53 of each of the biasing structures 50 and 52. The user simply rotates the knob 92, so as to regulate the position of the cone shaped bearing member 87 and accordingly the tapered bearing surface 88 in either of two opposite directions as indicated by directional arrow 93. A plurality of biasing springs 94 engage connecting members 95 in the manner shown in FIG. 12 so as to supply the indicated resistance force onto the arms 34 and 36. More specifically, operation of the adjustment assembly 86 is accomplished by selectively positioning the bearing member 87 in accordance with the directional arrow 93 such that cam surface 38" engages the bearing surface 88 at various points along its length. The cam surface 38" is also tapered to correspond to the angular taper of the bearing surface 88. It should be apparent therefore that as the cam surface 38" engages the lower end of the bearing surface, as at 88', a lesser resistance force will be applied to each of the arms 34 and 36, by the biasing spring 94. To the contrary, when the cam surface 38" is forced into engagement with the opposite end of the bearing surface as at 88", a greater amount of resistance force would be applied to the arms 34 and 36, in that the biasing springs 94 will be forced inwardly and compressed a greater amount, resulting in the generation of a greater resistance force.

Figure 7:
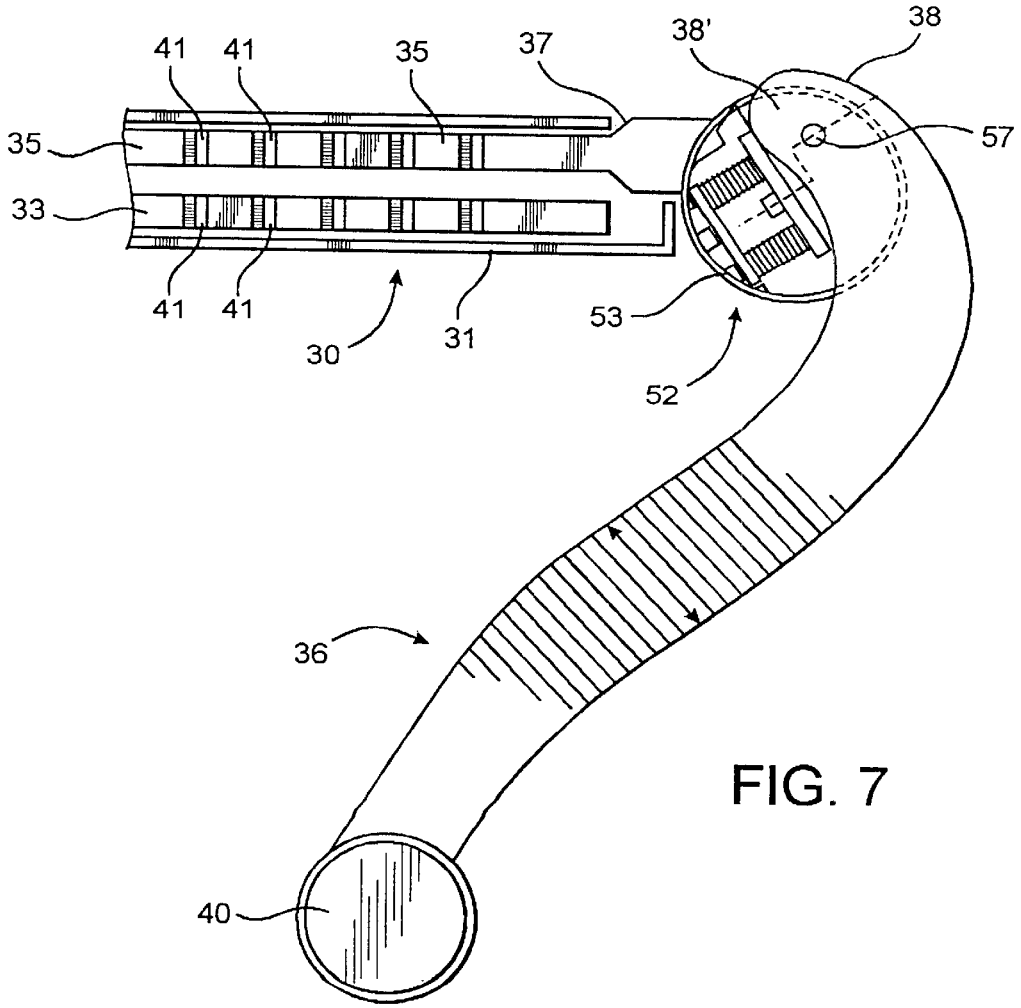
FIG. 7 is a top sectional view of the embodiment of FIG. 6.

Yet another structural feature of the present invention includes the ability to horizontally or laterally adjust the position of the each of the arms 34 and 36 relative to the base 30. More specifically, mounting slide plates or like support structures 33 and 35 are disposed within the interior of the casing 31 of the base 30, as shown in both FIGS. 6 and 7. Each of the slide plates 33 and 35 are fixedly secured by a connector member 37 to a corresponding one of the housings 53 of the biasing structures 50 and 52. As shown in FIG. 7, each of the slide plates 33 and 35 are positionable outwardly from a corresponding end of the casing 31 of the base 30, so as to selectively vary the distance that each of the arms 34 and 36 may be outwardly or laterally positioned from the casing 31. By virtue of this additional adjustable feature, the size, stature, physique, etc. of a variety of different user's may be easily accommodated, thereby allowing each of the user's to perform the prescribed exercises in the intended manner. With regard to FIG. 6, a locking pin or the like structure as at 39 is located in cooperative relation to each of the slide plate or like supporting structures 33 and 35. The locking pin 39 passes through an upper end 31' of the casing 31 and fits within one of a plurality of locking grooves 41 as shown.

In the performance of the aforementioned prescribed exercise movement the user 100 will reach out in front of the chest area gripping each of the handles 40 with a different hand. The position of the user's arms as best shown in FIG. 2 are initially such that the arms are bent at the elbow and assume a substantially 90 degree angle of orientation, indicated in FIG. 3 as 54, between the lower arm portion and the upper arm portion. In addition, the position of each arm, with the elbows bent approximately 90 degrees, as set forth above, will be horizontal and parallel to the pivot arm of the base 30 or the pivotal interconnection of each of the arms 34 and 36 at their distal end 38. The user 100 will begin to exercise by equally pulling back on each of the arms 34 and 36, having gripped both handles 40 and directing the arms 34 and 36 in a semi-circular motion. At the same time the user 100 will retract the shoulders to the extent of pulling the shoulder blades back towards one another to the closest point the body will allow the user without experiencing undo discomfort or pain. Such movement will allow the retractor muscles, primarily the rhomboid muscles, to contract as sufficient tension is exerted on the arms 34 and 36 by the user 100 in opposition to the resistance force placed on the arms by the aforementioned tension assembly generally and the biasing structures 50 and 52 specifically. Once the arms 34 and 36 are disposed in their outermost or preferred extended position, as generally demonstrated in FIG. 3, the arms 34 and 36 are allowed to slowly return back to their retracted position, as shown in FIG. 1, while the user still exerts somewhat of a retaining force thereon in opposition to the resistance force exerted on the arms 34 and 36 by the respective biasing structures 50 and 52.

Yet additional structural features of the exercise assembly 10 of the present invention comprise the inclusion of a plurality of pads or cushions as at 60 extending beneath any one or all of the straps 14, 16, 20 and 22, as well as the front support plate 18 and the back support plate 26. Also, in at least one embodiment of the present invention the arms have a curvilinear configuration along their length, between their proximal ends 38 and their distal ends or handles 40. Further, the handles 40 are cooperatively dimensioned and configured with the curvilinear configuration of each of the arms 34 and 36, so as to provide an ergonomic structure, which facilitates the gripping of the arms 34 and 36 and their repeated positioning between the retracted position and the outwardly extended position.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. An exercise assembly structured to exercise the retractor muscles of the upper torso of a user's body, said assembly comprising:

a) a mounting assembly adapted to be attached to the user's body, b) a substantially rigid base including a center and connected to said mounting assembly and adapted to be disposed in substantially overlying relation to a frontal area of the user's body, c) a pair of arms movably connected to said base and selectively disposable by the user between a retracted position and an extended position, each of said pair of arms extending on opposite sides of said center of said base, d) a tension assembly connected to said pair of arms and exerting a resistance force thereon, and e) said tension assembly disposed to exert the resistance force in opposing relation to movement of said pair of arms from said retracted position to said extended position.

2. An exercise assembly as recited in claim 1 wherein said base is removably connected to said mounting assembly.

3. An exercise assembly as recited in claim 1 wherein said mounting assembly is adapted to be adjustably secured to the user's body and selectively adjustable to dispose said base in a predetermined position on the user's body.

4. An assembly as recited in claim 3 wherein said mounting assembly comprises a harness adapted to be removably attached to the upper torso in overlying relation to the upper chest area.

5. An assembly as recited in claim 4 wherein said harness is adapted to be disposed in supported, at least partially depending relation to the user's shoulders.

6. An exercise assembly as recited in claim 5 wherein said mounting assembly further comprises a support plate connected to said harness and adapted to be disposed in overlying relation to the user's chest.

7. An exercise assembly as recited in claim 6 wherein said mounting assembly comprises a back plate connected in substantially suspended, supported relation from said harness and adapted to be disposed in overlying relation to a back of the user.

8. An exercise assembly as recited in claim 7 wherein said back plate is configured and dimensioned to fit in an un-interruptive relation between the user's shoulder blades.

9. An assembly as recited in claim 8 wherein said base is removably connected to said mounting assembly.

10. An assembly as recited in claim 1 wherein each of said pair of arms are normally biased into said retracted position and movable outward from said base into said extended position.

11. An exercise assembly as recited in claim 10 wherein said tension assembly comprises two biasing structures each connected in biasing relation to a different one of said pair of arms.

12. An exercise assembly as recited in claim 11 wherein each of said pair of arms are pivotally connected to said base in spaced relation to one another, each of said biasing structures disposed in substantially interconnecting relation between a different one of said pair of arms and said base.

13. An assembly as recited in claim 12 wherein said retracted position is defined by said pair of arms disposed in outwardly spaced at least partially overlying relation to said base.

14. An assembly as recited in claim 13 wherein said extended position comprises said pair of arms disposed transversely outward from said base at a predetermined angular orientation relative thereto.

15. An exercise assembly as recited in claim 1 wherein said tension assembly comprises two biasing structures each at least partially disposed in movable biasing engagement with a proximal end of a different one of said pair of arms.

16. An exercise assembly as recited in claim 15 wherein each of said biasing structure including a bearing member disposed into movable, biasing engagement with a distal end of a different one of said pair of arms.

17. An exercise assembly as recited in claim 16 wherein each of said distal ends and each of said pair of arms including a cam surface formed thereon, said cam surface disposed in movable biased engagement with a corresponding one of said bearing structures.

18. An exercise assembly as recited in claim 17 wherein at least one of said bearing structures includes a substantially conical configuration comprising an at least partially tapered bearing surface, said cam surface on a corresponding distal end of one of said pair of arms selectively positionable along the length of said bearing surface so as to selectively regulate an amount of biasing, resistance force exerted on said one arm.

19. An exercise assembly adapted to be secured to a user's body, said exercise assembly comprising:

a) a substantially rigid base including a center and adapted to be secured to the user's body and disposed in substantially overlying relation to a frontal area thereof, b) a pair of arms each including a proximal end and a distal end, said proximal ends pivotally connected to said base and each of said distal ends including a handle formed thereon, c) said pair of arms selectively disposable between a retracted position and an extended position, each of said pair of arms extending on opposite sides of said center of said base, d) a tension assembly disposed to exert a resistance force on said pair of arms and including a pair of biasing structures, e) each of said pair of biasing structures interconnected between said base and said proximal end of a different one of said pair of arms, and f) said pair of biasing structures disposed to exert said resistance force against movement of said pair of arms from said retracted position to said extended position.

20. An assembly as recited in claim 19 wherein each of said pair of arms are normally biased into said retracted position and moveable outward from said base into said extended position.

21. An exercise assembly as recited in claim 20 wherein said retracted position is defined by said pair of arms disposed in outwardly spaced at least partially overlying relation to said base and said extended position is defined by said pair of arms disposed transversely outward from said base at an angular orientation of at least substantially 90 degrees relative to said base.

22. An exercise assembly adapted to be secured to a user's body, said exercise assembly comprising:

a) a mounting assembly including a harness adapted to be adjustably attached to the upper torso in overlying relation to the user's upper chest area, b) a substantially rigid base including a center and connected to said mounting assembly and adapted to be disposed in overlying relation to a frontal area of the user's body, c) a pair of arms each including a proximal end and a distal end, said proximal ends pivotally connected to said base and each of said distal ends including a handle formed thereon, d) said pair of arms selectively disposable between a retracted position and an extended position, each of said pair of arms extending on opposite sides of said center of said base, e) a tension assembly disposed to exert a resistance force on said pair of arms and including a pair biasing structures, f) each of said pair of biasing structures interconnected between said base and said proximal end of a different one of said pair of arms, and g) said pair of biasing structures disposed to exert said resistance force against movement of said biasing structure from said retracted position to said extended position.

23. An exercise assembly is recited in claim 22 wherein said harness further comprises a support plate adapted to be disposed in overlying relation to the user's chest and connected to said base.

24. An exercise assembly as recited in claim 23 wherein said base is removably connected in supported engagement on said support plate.

25. An exercise assembly as recited in claim 23 wherein said harness further comprises a back plate adapted to be disposed in a overlying relation to a back of the user, said back plate configured and dimensioned to allow un-interrupted scapular movement of the user's shoulder blades.

26. An assembly as recited in claim 22 wherein each of said pair of arms includes a substantially curvilinear configuration extending between said proximal and said distal end thereof.

* * * * *